US009885311B2

(12) United States Patent
Taniguchi et al.

(10) Patent No.: US 9,885,311 B2
(45) Date of Patent: Feb. 6, 2018

(54) METHOD FOR MANUFACTURING CYLINDER BLOCK AND CYLINDER BLOCK

(71) Applicant: NISSAN MOTOR CO., LTD., Yokohama-shi, Kanagawa (JP)

(72) Inventors: Kazuaki Taniguchi, Isehara (JP); Yoshiaki Miyamoto, Yokohama (JP); Daisuke Terada, Yokohama (JP); Eiji Shiotani, Kawasaki (JP); Yoshitsugu Noshi, Yokohama (JP); Takafumi Watanabe, Chigasaki (JP); Kiyokazu Sugiyama, Chigasaki (JP); Hirotaka Miwa, Yokohama (JP); Mitsuo Hayashi, Kawasaki (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 14/359,829

(22) PCT Filed: Oct. 30, 2012

(86) PCT No.: PCT/JP2012/077987
§ 371 (c)(1),
(2) Date: May 21, 2014

(87) PCT Pub. No.: WO2013/077147
PCT Pub. Date: May 30, 2013

(65) Prior Publication Data

US 2014/0311438 A1 Oct. 23, 2014

(30) Foreign Application Priority Data

Nov. 22, 2011 (JP) ..... 2011-254793

(51) Int. Cl.
*F02F 1/00* (2006.01)
*C23C 4/12* (2016.01)
(Continued)

(52) U.S. Cl.
CPC ..... *F02F 1/00* (2013.01); *C23C 4/12* (2013.01); *C23C 4/129* (2016.01); *B05B 7/222* (2013.01); *B05B 13/0636* (2013.01); *F02F 1/18* (2013.01)

(58) Field of Classification Search
CPC ..... C23C 4/02
(Continued)

(56) References Cited

U.S. PATENT DOCUMENTS 5,271,967 A * 12/1993 Kramer ..... C23C 4/12 29/888.061
5,822,057 A * 10/1998 Samman ..... G02B 23/26 356/237.1
(Continued)

FOREIGN PATENT DOCUMENTS

CN 1341156 A 3/2002
EP 0 330 196 B1 7/1992
(Continued)

OTHER PUBLICATIONS

U.S. Appl. No. 14/366,506, filed Jun. 18, 2014, Miwa et al.
(Continued)

*Primary Examiner* — John Kwon
*Assistant Examiner* — James Kim
(74) *Attorney, Agent, or Firm* — Foley & Lardner LLP

(57) ABSTRACT

A thermally sprayed coating is formed on an inner surface of a cylinder bore of a cylinder block by using a thermal spray gun. The thermal spray gun is reciprocated along an axial direction in the cylinder bore while being rotated, and injects melted droplets generated by melting a wire made of a ferrous material from a nozzle at its end. At this time, a moving speed of the thermal spray gun along the axial direction into the cylinder bore is made equal-to or larger-than a predetermined value, and the number of reciprocating
(Continued)

cycles of the thermal spray gun along the axial direction into the cylinder bore is made equal-to or larger-than a predetermined value.

6 Claims, 4 Drawing Sheets

(51) Int. Cl.

| | |
|---|---|
| ***C23C 4/129*** | (2016.01) |
| *F02F 1/18* | (2006.01) |
| *B05B 7/22* | (2006.01) |
| *B05B 13/06* | (2006.01) |

(58) Field of Classification Search
USPC ..... 123/193.2; 427/236, 455
See application file for complete search history.

(56) References Cited

U.S. PATENT DOCUMENTS

| | | | | |
|---|---|---|---|---|
| 6,544,597 | B2 * | 4/2003 | Takahashi | C23C 4/08 427/446 |
| 6,634,179 | B2 | 10/2003 | Heinemann et al. | |
| 2002/0012753 | A1 | 1/2002 | Heinemann et al. | |
| 2002/0018858 | A1 * | 2/2002 | Takahashi | C23C 4/08 427/455 |
| 2003/0152698 | A1 | 8/2003 | Smith et al. | |
| 2003/0152699 | A1 | 8/2003 | Someno et al. | |
| 2004/0265163 | A1 * | 12/2004 | Doty | C22C 21/04 420/548 |
| 2005/0087323 | A1 * | 4/2005 | Hathaway | B22D 29/002 164/522 |
| 2005/0235944 | A1 * | 10/2005 | Michioka | C23C 4/02 123/193.2 |
| 2007/0190272 | A1 * | 8/2007 | Kanai | C23C 4/124 428/34.1 |

FOREIGN PATENT DOCUMENTS

| | | | |
|---|---|---|---|
| EP | 2 052 785 | A1 | 4/2009 |
| JP | 01-309952 | A | 12/1989 |
| JP | 04-072051 | A | 3/1992 |
| JP | 09-248606 | A | 9/1997 |
| JP | 11-050225 | A | 2/1999 |
| JP | 11-106891 | A | 4/1999 |
| JP | 11-264341 | A | 9/1999 |
| JP | 2000-136827 | A | 5/2000 |
| JP | 2002-030411 | A | 1/2002 |
| JP | 2006-291336 | A | 10/2006 |

OTHER PUBLICATIONS

U.S. Appl. No. 14/367,590, filed Jun. 20, 2014, Hayashi et al.
Yanan Li, Application of Thermally Spraying (Welding) Technics in Automobile Repair, Nov. 1992, pp. 24, 26, 58-63, China Communication Press.

* cited by examiner

METHOD FOR MANUFACTURING CYLINDER BLOCK AND CYLINDER BLOCK

TECHNICAL FIELD

The present invention relates to a method for manufacturing a cylinder block to form a spray coating on an inner surface of a cylinder bore, and to a cylinder block.

BACKGROUND ART

In view of improvements of power, fuel consumption, emission performance, down-sizing and light-weighting of an internal combustion engine, elimination of a cylinder liner to be applied to a cylinder bore of an aluminum cylinder block is highly desired in design requirements. As one of alternative techniques accommodating the requirements, proceeding is an application of a thermal spray technology for forming a thermally sprayed coating made of a ferrous material on an inner surface of a cylinder bore (see Patent Literature 1 listed below).

CITATION LIST

Patent Literature

Patent Literature 1: Japanese Unexamined Patent Publication No. 2006-291336

SUMMARY OF INVENTION

Technical Problem

By the way, when forming a thermally sprayed coating, a wire made of a ferrous material as a thermally sprayed material is supplied to an end-side of a thermal spray gun, and melted droplets generated by heating and melting the wire by a heat source such as plasma arc are sprayed-toward and then attached-onto an inner surface of a cylinder bore. Therefore, the cylinder block is heated at thermal spraying and its temperature rises, so that it is brought into a state where internal stresses are accumulated.

When machining works for an outer shape of the cylinder block and so on are made, as a pre-stage machining process, to the cylinder block in the state where the internal stresses are accumulated, the accumulated internal stresses are released and thereby deformations occurs in an entire of the cylinder block. Therefore, working operations in a following finishing work process are subject to be complicated due to a need of fixing the deformations.

Therefore, an object of the present invention is to restrict temperature rise of a cylinder block when forming a thermally sprayed coating.

Solution to Problem

The present invention is characterized by controlling at least any one of heat input to the cylinder block and heat radiated from a cylinder block when forming a thermally sprayed coating on an inner surface of a cylinder bore of the cylinder block by reciprocating a thermal spray gun along an axial direction in the cylinder bore while rotating the thermal spray gun.

Advantageous Effects of Invention

According to the present invention, by controlling temperature of at least any one of the heat input to the cylinder block and the heat radiated from the cylinder block so that internal stresses accumulated in the cylinder block are reduced, it becomes possible to restrict deformations of the cylinder block caused by the releases of the internal stresses at working operations after thermal spraying, and thereby following finishing working operations can be done easily.

DESCRIPTION OF EMBODIMENTS

Hereinafter, embodiments for conducting the present invention will be explained in detail with reference to the drawings.

First Embodiment

Figure 1:
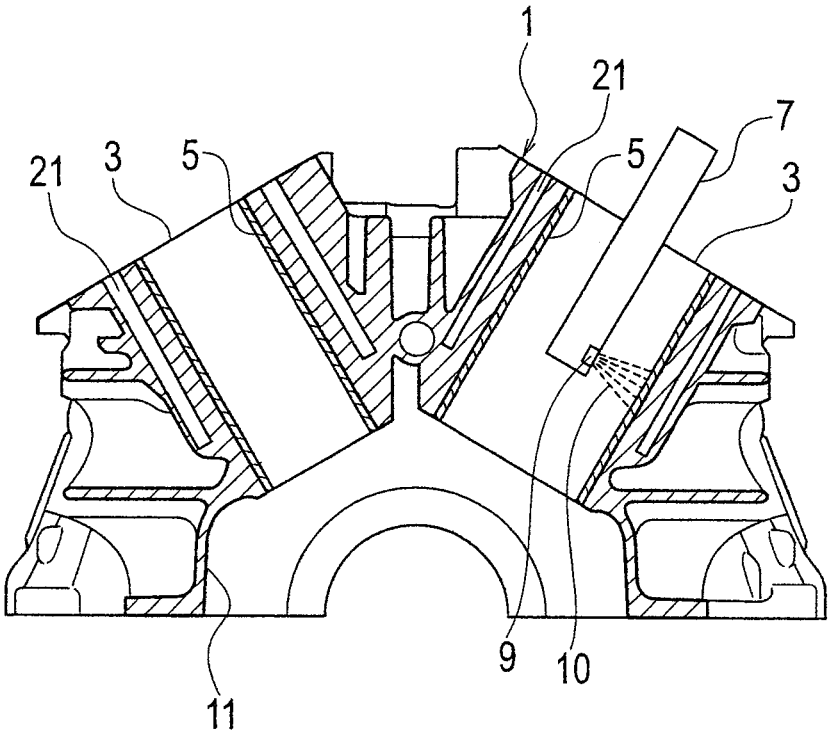
FIG. 1 is a cross-sectional view of a cylinder block according to a first embodiment of the present invention.

A cylinder block 1 shown in FIG. 1 of a V-type engine for an automobile is an aluminum alloy product and its properties such as an anti-abrasion property are improved by forming thermally sprayed coatings 5 on inner surfaces of cylinder bores 3. A method for forming the thermally sprayed coating 5 is one that is conventionally well-known, and done by inserting a thermal spray gun 7 into the cylinder bore 3 while rotating it, reciprocating it along an axial direction, and injecting melted droplets 10 from a nozzle 9 on an end of the thermal spray gun 7 to attach them onto the inner surface of the cylinder bore 3. A wire not shown and made of a ferrous material to be a material for thermal spraying is continuously supplied to the nozzle 9 from an outside of the thermal spray gun 7, and then the melted droplets 10 are generated by melting the wire by a heat source such as plasma arc.

Bearing caps not shown are fastened and fixed on a bottom surface, on a crankcase 11 side, of the cylinder block 1 by bolts. The bearing caps rotatably support a crankshaft not shown between the cylinder block 1 and their bearing portions.

An oil pan not shown is attached to an opposite bottom surface of the crankcase 11 to the cylinder block 1, and a cylinder head is attached to an opposite upper surface of the cylinder block 1 to the crankcase 11.

Figure 2:
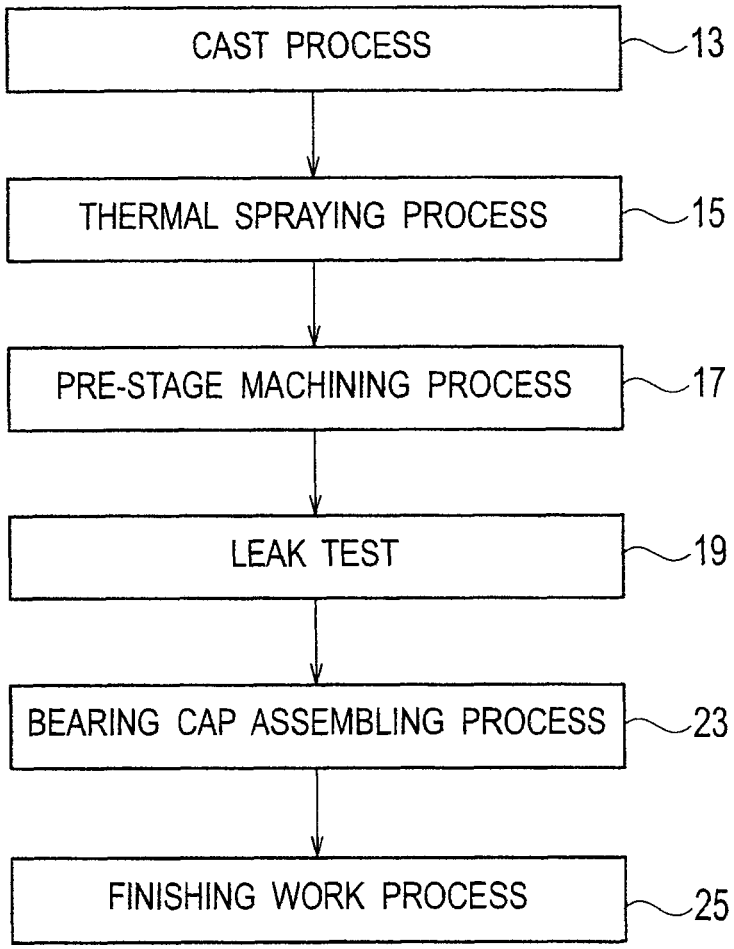
FIG. 2 is a manufacturing process diagram of the cylinder block shown in FIG. 1.

Manufacturing processes of the cylinder block 1 are shown in FIG. 2. After casting the cylinder block 1 in a cast process 13, the thermally sprayed coatings 5 are formed on the inner surfaces of the cylinder bores 3 in a thermal spraying process 15. After the thermal spraying process 15, machining works for an outer shape of the cylinder block 1 are made as a pre-stage machining process 17, and then a leak test 19 is done.

The leak test 19 is a test for fluid leaks with respect to coolant leaks in a water jacket 21 and lubrication oil leaks in the crankcase 11. This leak test 19 is conventionally well-known, and bone by adding pressure into the water jacket 21 and the crankcase 11 in a state where they are sealed up, and then judging whether or not inner pressures in the water jacket 21 and the crankcase 11 are not lower than a prescribed value after predetermined time has elapsed.

After the leak test 19, the bearing caps not shown are attached to the cylinder block 1 in a bearing cap assembling process 23, and finishing works are done in a finishing work process 25 at the end. The finishing work process 25 includes honing works to the thermally sprayed coatings 5 formed on the inner surfaces of the cylinder bores 3.

By the way, the cylinder block 1 is heated at thermal spraying in the thermal spraying process 15 of the manufacturing processes shown in the above FIG. 2 and its temperature rises, so that it is brought into a state where internal stresses are accumulated. When the machining works for an outer shape of the cylinder block 1 are made to the cylinder block 1 in the state where the internal stresses are accumulated in the pre-stage machining process 17 after thermal spraying, the accumulated internal stresses are released and thereby deformations occur in an entire of the cylinder block, and thereby working operations in the following finishing work process 25 are subject to be complicated.

As the deformations of the cylinder block 1, its upper end surface on an opposite side to the crankcase 11 may generally curve downward, and a cross-sectional shape of the cylinder bore 3 may become ellipsoidal or oval as against circular. A fixing work for making the upper end surface flat is required in a case where the upper end surface of the cylinder block 1 curves downward, and a fixing work for making the cross-sectional shape circular by a finishing honing work is required for the deformation of the cross-sectional shape of the cylinder bore 3. Especially, since more working margins are needed in order to fix the cross-sectional shape of the cylinder bore 3 from an ellipsoidal or oval shape to a circular shape, a thermally sprayed coating must be preliminarily formed thicker and thereby its material costs increase for that.

Figure 3:
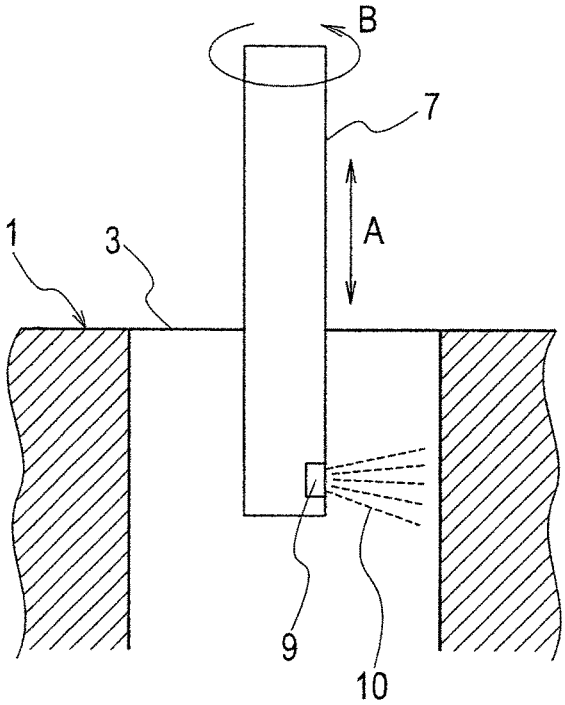
FIG. 3 is an operationally explanatory view showing a state where a thermally sprayed coating is formed on an inner surface of a cylinder bore of the cylinder block shown in FIG. 1.

Therefore, in the present embodiment, in the thermal spraying process 15, as shown in FIG. 3, when forming the thermally sprayed coating 5 on the inner surface of the cylinder bore 3 by inserting the thermal spray gun 7 into the cylinder bore 3 while rotating it, a moving speed of the thermal spray gun 7 along the axial direction indicated by an arrow A in the cylinder bore 3 is set to a value equal-to or larger-than a predetermined value, e.g. 2000 to 3000 mm/min.

A heat input amount to the cylinder block 1 (a heat amount that the cylinder block 1 receives per unit time and per unit volume) at thermal spraying becomes smaller for an identical moving stroke as the moving speed of the thermal spray gun 7 along the axial direction becomes faster. Therefore, a heat input amount to the cylinder block 1 for a single reciprocating cycle of the thermal spray gun 7 in the cylinder bore 3 along the axial direction is reduced by setting the moving speed of the thermal spray gun 7 along the axial direction to a value equal-to or larger-than the predetermined value. Namely, in the present embodiment, temperature of the cylinder block 1 is controlled by adjusting the heat input amount to the cylinder block 1 to be restricted when forming the thermally sprayed coating 5 on the inner surface of the cylinder bore 3.

As a result, the heat input amount to the cylinder block 1 at thermal spraying can be restricted lower, and thereby temperature rise of the cylinder block 1 can be restricted. Therefore, the internal stresses accumulated in the cylinder block 1 can be reduced further, and the deformations of an entire of the cylinder block caused by the releases of the internal stresses at the working operations in the pre-stage machining process 17 following the thermal spraying process 15 can be restricted smaller. By restricting the deformations of an entire of the cylinder block smaller, working operations in the following finishing work process 25 can be made easy.

On the other hand, as explained above, when the moving speed of the thermal spray gun 7 along the axial direction into the cylinder bore 3 is set to a value equal-to or larger-than the predetermined value, a thermally sprayed amount for an identical moving stroke reduces. Therefore, in the present embodiment, by setting the number of reciprocating cycles of the thermal spray gun 7 along the axial direction in the cylinder bore 3 is set to a value equal-to or larger-than a predetermined value, e.g. 4 to 7 cycles (total stroked distance is made longer), a thermally sprayed amount to be reduced is compensated. According to this, a coating thickness of the thermally sprayed coating 5 can be surely kept at a constant predetermined value.

Namely, in the present embodiment, when forming the thermally sprayed coating 5 on the inner surface of the cylinder bore 3 by reciprocating the thermal spray gun 7 along the axial direction in the cylinder bore 3 of the cylinder block 1 while rotating it, temperature of the cylinder block 1 is controlled while keeping the coating thickness of the thermally sprayed coating 5 constant. Controlling of the temperature of the cylinder block 1 is equivalent to controlling at least any one of heat input to the cylinder block 1 and heat radiated from the cylinder block 1. To do so in the present embodiment, correlation between the moving speed of the thermal spray gun 7 in the axial direction in the cylinder bore 3 and the number of reciprocating cycle of the thermal spray gun 7 in the cylinder bore 3 is set so that proportion of heat generated through thermal spraying and received by the cylinder block 1 when forming the thermally sprayed coating 5 is made lower. Here, an event that the proportion of heat received by the cylinder block 1 at thermal spraying is made lower is equivalent to an event that heat amount received by the cylinder block 1 at thermal spraying (heat input amount) is reduced.

In this manner, since the heat input amount to the cylinder block 1 at thermal spraying can be restricted to be made smaller in the present embodiment, the internal stresses (remnant stresses) accumulated in the cylinder block 1 reduces further. Therefore, since the accumulated internal stresses are smaller in the pre-stage machining process 17 following the thermal spraying process 15, the deformations of an entire of the cylinder block caused by the releases of the internal stresses can be restricted small and thereby working operations in the following finishing work process 25 can be made easy.

Note that a fact that the number of reciprocating cycles of the thermal spray gun 7 is set to a value equal-to or larger-than a predetermined value when the moving speed of the thermal spray gun 7 is set to a value equal-to or larger-than the predetermined value brings about a fact that the number of reciprocating cycles of the thermal spray gun 7 is made larger when the moving speed of the thermal spray gun 7 is made faster.

Second Embodiment

In a second embodiment, as shown in FIG. 3, when forming the thermally sprayed coating 5 on the inner surface of the cylinder bore 3 in the thermal spraying process 15 by inserting the thermal spray gun 7 into the cylinder bore 3 while rotating it, a rotating speed of the thermal spray gun 7 along a rotational direction indicated by an arrow B is set to a value equal-to or larger-than a predetermined value, e.g. 500 rpm. In this manner, similarly to the above-explained case where the axial speed is made faster, the heat input amount to the cylinder block 1 for a single rotation of the thermal spray gun 7 in the cylinder bore 3 is reduced.

Namely, in the present embodiment, temperature of the cylinder block 1 is controlled by adjusting the heat input amount to the cylinder block 1 to restrict it when forming the thermally sprayed coating 5 on the inner surface of the cylinder bore 3.

As a result, similarly to the first embodiment, the heat input amount to the cylinder block 1 at the thermal spraying can be restricted lower, and thereby temperature rise of the cylinder block 1 can be restricted and thereby the internal stresses accumulated in the cylinder block 1 can be reduced further. According to this, the deformations of an entire of the cylinder block caused by the releases of the internal stresses at the working operations in the pre-stage machining process 17 following the thermal spraying process 15 can be restricted smaller, and thereby working operations in the following finishing work process 25 can be made easy.

On the other hand, as explained above, when the rotating speed of the thermal spray gun 7 is set to a value equal-to or larger-than the predetermined value, a thermally sprayed amount for a single rotation of the thermal spray gun 7 reduces. Therefore, by setting the moving speed of the thermal spray gun 7 along the axial direction into the cylinder bore 3 is set to a value equal-to or smaller-than a predetermined value, e.g. 1000 to 1500 mm/min, i.e. made slower, a thermally sprayed amount to be reduced is compensated. According to this, a coating thickness of the thermally sprayed coating 5 can be surely kept at a constant predetermined value.

Namely, also in the present embodiment, when forming the thermally sprayed coating 5 on the inner surface of the cylinder bore 3 by reciprocating the thermal spray gun 7 along the axial direction in the cylinder bore 3 of the cylinder block 1 while rotating it, temperature of the cylinder block 1 is controlled while keeping the coating thickness of the thermally sprayed coating 5 constant. To do so in the present embodiment, a correlation between the rotating speed of the thermal spray gun 7 and the moving speed the thermal spray gun 7 in the axial direction in the cylinder bore 3 is set so that proportion of heat received by the cylinder block 1 when forming the thermally sprayed coating 5 while keeping the coating thickness of the thermally sprayed coating 5 constant is made lower.

In this manner, since the heat input amount to the cylinder block 1 at thermal spraying can be restricted to be made smaller also in the present embodiment, the internal stresses (remnant stresses) accumulated in the cylinder block 1 reduces further. Therefore, since the accumulated internal stresses are smaller in the pre-stage machining process 17 following the thermal spraying process 15, the deformations of an entire of the cylinder block caused by the releases of the internal stresses can be restricted small and thereby working operations in the following finishing work process 25 can be made easy.

Note that a fact that the moving speed of the thermal spray gun 7 is set to a value equal-to or smaller-than the predetermined value when the rotating speed of the thermal spray gun 7 is set to a value equal-to or larger-than the predetermined value brings a fact that the moving speed of the thermal spray gun 7 along the axial direction in the cylinder bore 3 is made slower according as the rotating speed of the thermal spray gun 7 is made faster.

In the above-explained second embodiment, the moving speed of the thermal spray gun 7 along the axial direction is made slower when making the rotating speed of the thermal spray gun 7 faster. Although decrease of the moving speed of the thermal spray gun 7 along the axial direction brings increase of the heat input amount to the cylinder block 1 at thermal spraying, the moving speed of the thermal spray gun 7 along the axial direction shall be made slower as long as a reduced amount of the above-explained heat input amount by making the rotating speed of the thermal spray gun 7 faster doesn't get balanced out.

Third Embodiment

Figure 4:
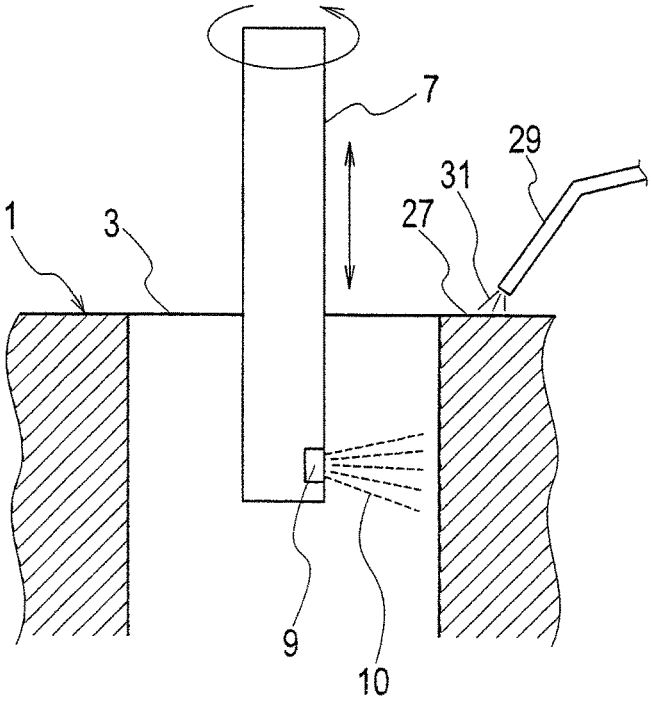
FIG. 4 is an operationally explanatory view corresponding to FIG. 3 by a third embodiment.

In a third embodiment, as shown in FIG. 4, when forming the thermally sprayed coating 5 on the inner surface of the cylinder bore 3 in the thermal spraying process 15 by inserting the thermal spray gun 7 into the cylinder bore 3 while rotating it, the cylinder block 1 is cooled. The temperature of the cylinder block 1 is controlled by adjusting heat radiation amount (a heat amount that the cylinder block 1 radiates per unit time and per unit volume) from the cylinder block 1 to be increased by cooling the cylinder block 1 when forming the thermally sprayed coating 5 on the inner surface of the cylinder bore 3. Namely, in the present embodiment, temperature of the cylinder block 1 is controlled by controlling at least any one of heat input to the cylinder block 1 and heat radiated from the cylinder block 1.

As a cooling method, as shown in FIG. 4, coolant 31 as cooling refrigerant injected from a coolant nozzle 29 is supplied to an upper end surface 27 near the cylinder bore 3 of the cylinder block 1. At this time, a countermeasure for restricting the coolant 31 from flowing into the cylinder bore 3 is taken arbitrarily. Air-blowing for supplying gas such as air instead of the coolant 31 may be done, and the cooling method is not limited to these and takes others as long as the cylinder block 1 can be cooled. Temperature of the cooling refrigerant is set to almost 20 to 50° C.

Temperature rise of the cylinder block can be restricted by cooling the cylinder block 1 to radiate heat input through thermal spraying effectively, and thereby the internal stresses accumulated in the cylinder block 1 can be reduced further. According to this, the deformations of an entire of the cylinder block caused by the releases of the internal stresses at the working operations in the pre-stage machining process 17 following the thermal spraying process 15 can be restricted smaller, and thereby working operations in the following finishing work process 25 can be made easy.

Figure 5:
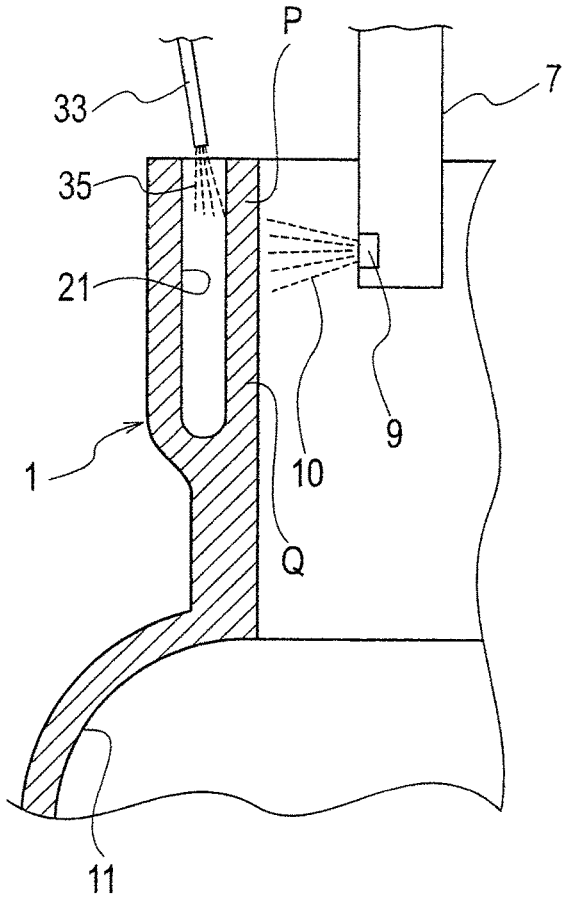
FIG. 5 is an operationally explanatory view showing a state where cooling is done by injecting air onto a cylinder block at thermal spraying.

When cooling the cylinder block 1, as shown in FIG. 5, it is desired to cool a portion P where a water jacket 21 is formed or a middle portion Q of the cylinder bore 3 along its axial direction intensively. This is because the portion P where the water jacket 21 is formed tends to be thinner than other portions and thereby its temperature easily rises, and heat input through thermal spraying is radiated more poorly at the middle portion Q of the cylinder bore 3 along its axial direction than at an end(s) along the axial direction and thereby its temperature easily rises.

Figure 6:
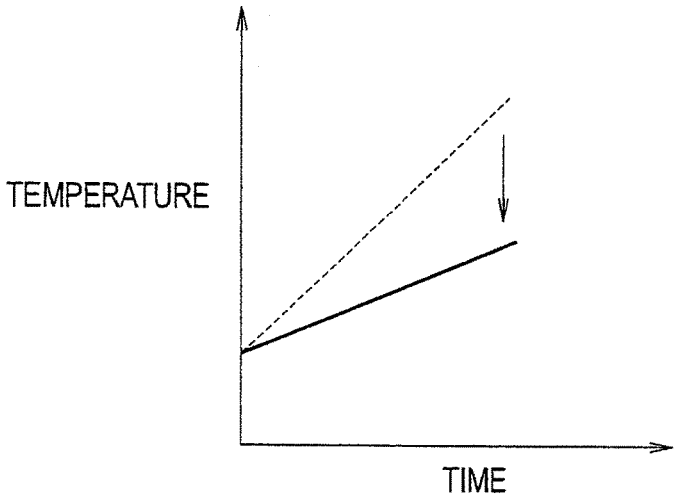
FIG. 6 is a graph showing a comparison of temperature changes of cylinder blocks along with time course during thermal spraying between a case where cooling is done (solid line) and a case where not done (dotted line).

At that time, by injecting air or injecting gas 35 composed of inactive gas such as nitrogen from a gas injection nozzle 33 into the water jacket 21, the portion P where the water jacket 21 is formed and the middle portion Q of the cylinder bore 3 along its axial direction as shown in FIG. 5 can be cooled intensively. FIG. 6 shows, by a solid line, temperature changes when cooling the cylinder block 1 shown in FIG. 5. A dotted line indicates temperature changes without cooling, so that temperature rise of the cylinder block 1 with cooling is restricted further than without cooling.

Cooling of the cylinder block 1 in the above-explained third embodiment may be used together with the above-explained first embodiment or the above-explained second embodiment. According to this, temperature rise of the cylinder block 1 at thermal spraying can be restricted further.

Note that the thermal spraying process 15 is set following the cast process 13 in the manufacturing processes of the cylinder block 1 shown in FIG. 1. This is because, in a case where the thermal spraying process 15 is set as a later process, e.g. directly before the finishing work process 25, the cylinder block 1 will be condemned if a casting failure is found at thermal spraying and thereby process costs required for the cast process 13, the thermal spraying process 15, the pre-stage machining process 17, and so on are subject to be wasted.

In addition, setting the thermal spraying process 15 directly after the cast process 13 can reduce modifications for a manufacturing line for following processes, and thereby can contributes reduction of facility costs. If the thermal spraying process 15 is set as a later process, e.g. followed by the finishing work process 25, it is needed to implement the thermal spraying process 15 into the middle of an existing manufacturing line, so that extent of modifications for the line is subject to become large.

Therefore, the thermal spraying process 15 is desired to be set next after the cast process 13 as mush as possible, and thereby the pre-stage machining process 17 is needed to be done after the thermal spraying process 15.

The embodiments of the present invention are explained above, but these embodiments are mere examples described to make the present invention easily understood, and the present invention is not limited to the above embodiments. The technical scope of the present invention is not limited to specific technical matters disclosed in the above embodiments, and includes modifications, changes, alternative techniques easily derived from them. For example, explanations are made by using the cylinder block 1 of a V-type engine for an automobile in the above embodiments, but the present invention is applicable to a cylinder block of an in-line engine.

The present application claims a priority based on a Japanese Patent Application No. 2011-254793, filed on Nov. 22, 2011, and the entire contents of the application are incorporate herein by reference.

INDUSTRIAL APPLICABILITY

The present invention is applied to a cylinder block in which a thermal sprayed coating is formed on an inner surface of a cylinder bore.

The invention claimed is:

1. A method for manufacturing a cylinder block, comprising:

casting a cylinder block; and carrying out, directly after casting the cylinder block, a thermal spraying process for forming a thermally sprayed coating on an inner surface of a cylinder bore of the cylinder block by reciprocating a thermal spray gun along an axial direction in the cylinder bore while rotating the thermal spray gun, wherein, in the thermal spraying process, heat input to the cylinder block is controlled to reduce a heat amount received by the cylinder block by increasing a number of reciprocating cycles of the thermal spray gun in the cylinder bore when a moving speed of the thermal spray gun in the axial direction in the cylinder bore gets faster, wherein the moving speed of the thermal spray gun in the axial direction in the cylinder bore is in the range of 2,000 mm/min to 3,000 mm/min, and wherein the number of reciprocating cycles of the thermal spray gun in the cylinder bore is in the range of 4 cycles to 7 cycles.

2. The method for manufacturing a cylinder block according to claim 1, wherein the cylinder block is cooled when controlling the heat input to the cylinder block.

3. The method for manufacturing a cylinder block according to claim 2, wherein a water jacket of the cylinder block is cooled.

4. The method for manufacturing a cylinder block according to claim 2, wherein a middle portion of the cylinder block along the axial direction is cooled.

5. A method for manufacturing a cylinder block, comprising:

casting a cylinder block;

performing a thermal spraying process to apply a coating on an inner surface of a cylinder bore of the cylinder block;

machining an outer shape of the cylinder block; and performing a finishing work process on the cylinder block, wherein the thermal spraying process is carried out directly after the casting of the cylinder block, and the thermal spraying process comprises reciprocating a thermal spray gun along an axial direction in the cylinder bore while rotating the thermal spray gun; and controlling a moving speed of the thermal spray gun in the axial direction in the cylinder bore and a number of reciprocating cycles of the thermal spray gun in the cylinder bore to reduce a heat amount received by the cylinder block and produce a constant predetermined thickness of the thermally sprayed coating by increasing the number of reciprocating cycles of the thermal spray gun in the cylinder bore when the moving speed of the thermal spray gun in the axial direction in the cylinder bore gets faster, wherein the moving speed of the thermal spray gun in the axial direction in the cylinder bore is in the range of 2,000 mm/min to 3,000 mm/min, and wherein the number of reciprocating cycles of the thermal spray gun in the cylinder bore is in the range of 4 cycles to 7 cycles.

6. The method of claim 5, further comprising:

determining whether a casting failure is present, and when no casting failure is determined to be present, machining the outer shape of the cylinder block, wherein determining whether the casting failure is present occurs after the thermal spraying process.

* * * * *